US010792923B2

(12) United States Patent
Tarrida Tirado et al.

(10) Patent No.: US 10,792,923 B2
(45) Date of Patent: Oct. 6, 2020

(54) CALIBRATION OF PRINTHEAD CLEANING ELEMENT

(71) Applicant: HEWLETT-PACKARD DEVELOPMENT COMPANY, L.P., Spring, TX (US)

(72) Inventors: Francesc Tarrida Tirado, Sant Cugat del Valles (ES); Marc Lupon Navazo, Sant Cugat del Valles (ES); Alejandro Mielgo Barba, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/492,636

(22) PCT Filed: Oct. 27, 2017

(86) PCT No.: PCT/US2017/058840

§ 371 (c)(1),
(2) Date: Sep. 10, 2019

(87) PCT Pub. No.: WO2019/083547

PCT Pub. Date: May 2, 2019

(65) Prior Publication Data

US 2020/0247129 A1 Aug. 6, 2020

(51) Int. Cl.
*B41J 2/165* (2006.01)
*B41J 11/00* (2006.01)

(52) U.S. Cl.
CPC ..... *B41J 2/16579* (2013.01); *B41J 2/16544* (2013.01); *B41J 11/0095* (2013.01); *B41J 2002/16582* (2013.01)

(58) Field of Classification Search
CPC ..... B41J 11/0095; B41J 2002/16582; B41J 2/16579; B41J 2/16541; B41J 2/16544
See application file for complete search history.

(56) References Cited

U.S. PATENT DOCUMENTS

| | | | | |
|---|---|---|---|---|
| 6,802,590 | B2 | 10/2004 | Lim | |
| 7,731,319 | B2 | 6/2010 | Murcia et al. | |
| 8,002,382 | B2 | 8/2011 | Steinfield et al. | |
| 8,727,487 | B2 | 5/2014 | Nukui | |
| 8,851,664 | B2 * | 10/2014 | Spence | B41J 2/215 347/104 |
| 2006/0139396 | A1 | 6/2006 | Baker | |
| 2009/0237443 | A1 | 9/2009 | Miramanda et al. | |
| 2011/0222079 | A1 | 9/2011 | Bezenek et al. | |
| 2016/0028910 | A1 | 1/2016 | Bezenek et al. | |

FOREIGN PATENT DOCUMENTS

| | | |
|---|---|---|
| TW | M546020 | 7/2017 |
| WO | WO2017129267 A1 | 8/2017 |

* cited by examiner

*Primary Examiner* — Thinh H Nguyen
(74) *Attorney, Agent, or Firm* — HP Inc. Patent Department

(57) ABSTRACT

Certain examples described herein relate to calibrating a cleaning element for a printhead. A print medium sensor is aligned with a nozzle plane of the printhead to detect displacement, during a print job, of a print medium out of the nozzle plane. Relative movement between the cleaning element and the printhead is enacted. During this movement, activation of the print medium sensor is detected. A reference position for the cleaning element is stored based on the detected activation.

15 Claims, 4 Drawing Sheets

CALIBRATION OF PRINTHEAD CLEANING ELEMENT

BACKGROUND

A print device may be provided with a cleaning unit for cleaning a printhead of the print device. The cleaning unit may comprise a cleaning element such as a wiper blade that is drawn across the surface of the printhead to clean the printhead.

BRIEF DESCRIPTION OF THE DRAWINGS

Various features of the present disclosure will be apparent from the detailed description which follows, taken in conjunction with the accompanying drawings, which together illustrate, by way of example only, features of the present disclosure, and wherein.

DETAILED DESCRIPTION

Certain examples described herein provide a method and system for calibrating a cleaning element of a printing system. This may comprise determining a reference position for the cleaning element, such that it may be suitably applied to a printhead of the cleaning system. Use is made of a print medium sensor, which may be referred to as a crash or collision sensor. The print medium sensor is configured, during normal use of the printing system, to detect displacement of a print medium, e.g. a displacement out of a plane parallel to nozzles of the printhead. Certain examples described herein enact relative movement between the cleaning element and the print medium sensor, such that activation of the print medium sensor may be used to determine the reference position during calibration.

Certain examples described herein enable a cleaning element to be applied to a printhead with a correct force, e.g. a force that cleans nozzles of the printhead but that does not damage the printhead. In comparative printing systems, a distance between a printhead and a cleaning element may be set during manufacture and set within control instructions, e.g. firmware, of the printing system. However, during transportation and installation of components of the printing system, the cleaning element and the printhead may move from these factory settings (e.g. through vibration of the components and/or applied impulses during loading or unloading). Also, a cleaning element may degrade over time, e.g. an upper surface of a wiper may be subject to wear and/or a resilience of a sponge or rubber member may change. As such, the reference values stored within the firmware of the printing system are not accurate. This means that printheads are not properly cleaned. In certain cases, this may also lead to damage of the printheads; e.g. if a predefined distance has been reduced, a greater than expected force may be applied. Small misalignments may also be difficult to detect, and lead to print quality defects that accrue over time and that are difficult to resolve. In certain cases, an on-site visit from an engineer may re-calibrate the printing system.

Certain examples described herein address certain issues set out above by providing a calibration method and system that may be run following transportation and/or at repeated intervals during operation. Certain examples make use of existing functionality within the printing system to reduce the complexity and cost of re-calibration, e.g. no additional bespoke sensing systems are required. By using a properly calibrated printing system, print defects may be reduced and printhead lifetimes extended.

Figure 1:
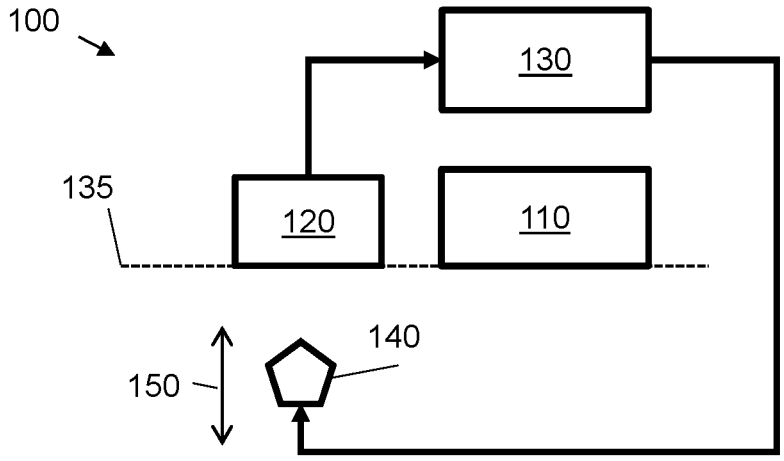
FIG. 1 is a schematic illustration of a printing system according to an example.

FIG. 1 shows a printing system 100 according to an example. The printing system 100 may comprise a two-dimensional or three-dimensional printing system. A three-dimensional printing system may comprise a printer that deposits a modelling agent onto a bed of build material. The printing system 100 comprises a printhead mounting 110, a print medium sensor 120, and control circuitry 130. The printhead mounting 110 is used to mount a printhead for printing. For example, the printhead mounting 110 may comprise a frame or chassis to receive a printhead. A printhead comprises a plurality of nozzles. For example, the printhead may comprise an ink-jet printhead. Ink or a modelling agent may be ejected through the nozzles of the printhead. The printhead may be a thermal or piezo-electric printhead. Within a printhead, the nozzles are aligned with a nozzle plane. This may be a lower surface of the printhead. In a printing system with multiple printheads, the nozzles of these multiple printheads may be aligned with a common nozzle plane. Dashed line 135 in FIG. 1 illustrates this plane. This plane also extends into the Figure, e.g. a printhead may have a width and a length within the plane. The printhead mounting may be of dimensions such that nozzles of a mounted printhead are aligned with the nozzle plane.

In FIG. 1, the print medium sensor 120 is aligned with the nozzle plane, e.g. as indicated by dashed line 135. The print medium sensor 120 is configured to detect, during a print job, displacement of a print medium out of a nozzle plane of the printhead. An example of how this may be achieved is described later with reference to FIG. 2B. The print medium sensor 120 may be configured to detect when a planar sheet or web of print media is deformed. In a three-dimensional, a print media may comprise a bed of build material. In this case, the print medium sensor 120 may detect when build material extends into a nozzle plane of the printhead. The printing system 100 may be configured to interrupt a print job if activation of the print medium sensor 120 is detected. In examples described herein, during a calibration routine such an interrupt may be disabled, so as to obtain data from the sensor. In normal use, this prevents warped and misconfigured print media from damaging the printhead mounting 110 and/or any printheads within. As indicated in FIG. 1, the print medium sensor 120 may be electronically coupled to the control circuitry 130. The control circuitry 130 may receive signals and/or data from the print medium sensor 120 to determine activation. The control circuitry 130 may comprise a printed circuit board and/or integrated circuitry. The control circuitry 130 may be located within the printing system 100. The control circuitry 130 may form part of a control sub-system that is electronically-coupled to a wider control system, e.g. may be coupled over a system bus to other printed circuit boards. The control circuitry 130 may comprise a processor in the form of a microprocessor or system-on-chip device. The control circuitry 130 may also comprise a memory to store instructions, e.g. in the form of firmware, for execution by such a processor. In other cases, the control circuitry may comprise an application specific integrated circuit (ASIC) to provide the functionality discussed herein.

FIG. 1 also shows a cleaning element 140 that is arranged to clean one or more printheads mounted within the printhead mounting 110. The cleaning element may comprise a wiper or sponge. The cleaning element 140 may clean the printheads by applying a calibrated force to the printheads. In an example, the cleaning element 140 may be moved to apply the force to the printheads, and a relative transverse movement may be enacted between the cleaning element and the printheads. For example, in FIG. 1 the cleaning element 140 may be moved vertically as shown by arrow 150 and the printhead mounting may be moved in a horizontal direction to wipe the printheads. In certain cases, multiple cleaning elements may be provided. One or more of these multiple cleaning elements may be calibrated according to the examples set out herein. For example, the printing system 100 may comprises two cleaning elements, one positioned on a servicing side of a printer and another positioned on an ink service station side of the printer.

In examples described herein, the control circuitry 130 is further configured to calibrate the cleaning element 140 using the components shown in FIG. 1. In particular, as shown by the arrow in FIG. 1, the control circuitry 130 is configured to move the cleaning element 140 relative to the printhead mounting 110 and to detect an activation of the print medium sensor 120. For example, in FIG. 1, the cleaning element 140 may be moved vertically by the control circuitry 130, as shown by arrow 150. A collision between the cleaning element 140 and the print medium sensor 120 may be detected by the control circuitry 130 by monitoring activation of the print medium sensor 120. As the print medium sensor 120 is arranged to detect a projection out of the nozzle plane, e.g. line 135, it may also be used to detect when the cleaning element 140 is aligned with the nozzle plane, e.g. in FIG. 1 a vertical displacement of the cleaning element 140 into the plane formed by the lower surface of the printhead mounting 110. The control circuitry 130 is configured to calibrate a reference position for the cleaning element based on the detected activation of the print medium sensor 120. In an example, the cleaning element 140 may be moved upwards in known increments from a resting position until a collision is detected. In that example, a number of increments between the resting position and the collision may be used to determine a reference position in the form of a distance or gap between the cleaning element 140 and the printhead mounting 110. For example, if there are 20 measured increments between a resting position of the cleaning element 140 and activation of the print medium sensor 120, and each increment is 1 mm, then the cleaning element 140 may be deemed to be 20 mm away from a printhead at rest. The reference position may be stored in a non-volatile memory by the control circuitry 130 and retrieved from this memory as a variable for use in cleaning routines. The non-volatile memory may form part of the control circuitry 130 or may form part of another control system. Likewise, cleaning routines may be applied by the control circuitry 130 or another control system.

Figure 2A:
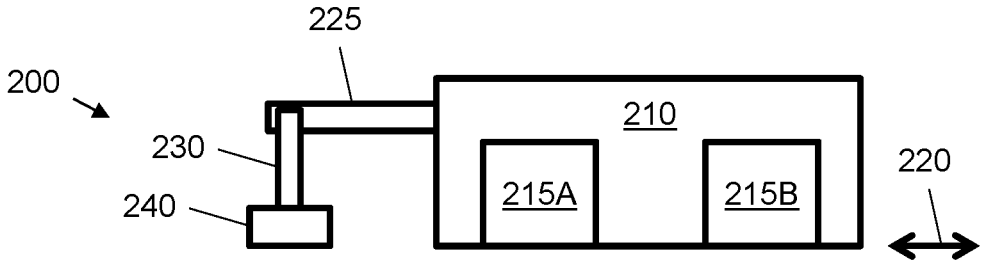
FIGS. 2A and 2B are schematic illustrations showing use of a print medium sensor according to an example.

FIG. 2A shows an example 200 of a particular print medium sensor and printhead mounting. In this example, the printhead mounting forms part of a moveable carriage 210 and is configured to mount two printheads 215A, 215B. The carriage 210 may comprise a metal or polymer chassis and is arranged to move laterally over a print medium, as shown by arrow 220. For example, the carriage 210 may be arranged above a media transport system and configured to move over a width of a print medium. Although two printheads are shown for example, 4, 6 or 8 printheads, amongst others, may be mounted. The printheads may comprise different printing fluids, e.g. Cyan, Magenta, Yellow, and Black inks and their variations. The printheads may also be used to deposit other printing fluids such as pretreatment fluids, overcoats, and detailing agents.

In the example of FIG. 2A, the print medium sensor is mechanically coupled to the moveable carriage 210 via arm 225. The arm 225 may comprise a statically-mounted cantilever structure. The arm 225 may be joined to the chassis of the moveable carriage 210, i.e. may form part of the carriage. In this case, the print medium sensor comprises a collision sensor pivotably-mounted to the arm 225. The collision sensor comprises an elongate member 230 and a base member 240. A lower surface of the base member 240 is aligned with the nozzle plane of the moveable carriage 210, which in this case is the base of the carriage. The base member 240 may be weighted, e.g. the collision sensor may form a pendulum.

Figure 2B:
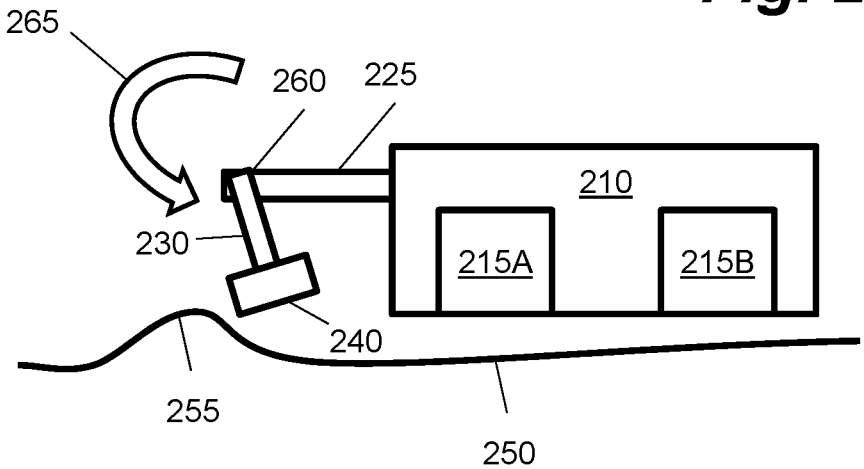

FIG. 2B shows how the collision sensor of FIG. 2A may be activated. In FIG. 2B, the moveable carriage 210 is moving over a print medium 250. The print medium 250 may comprise a sheet of print media and/or a web. The print medium 250 may be paper, cardboard, polymer, cloth etc. The elongate member 230 of the collision sensor is pivotable about a pivot axis 260 at a top of the elongate member 230, where the elongate member 230 is coupled to the arm 225. For example, the collision sensor may comprise a hinge at this position. The collision sensor is arranged such that a displacement 255 of the print medium 250 causes a collision between the base member 240 and the print medium 250. This applies a force to the base member 240 such that the elongate member 230 rotates about pivot axis 260, as indicated by arrow 265. This movement may be detected using a sensor such as a switch or rotary encoder. The movement thus triggers an activation of the collision sensor. For example, control circuitry such as 130 may be located within the moveable carriage 210 and receive a signal and/or read data from the sensor.

In normal use, activation of the print medium sensor in FIG. 2B may be used to stop the moveable carriage 210 so as to prevent displacement 255 of the print medium 250 from damaging the printheads 215. In certain examples described herein, this functionality is adapted to calibrate a cleaning element.

Figure 3A:
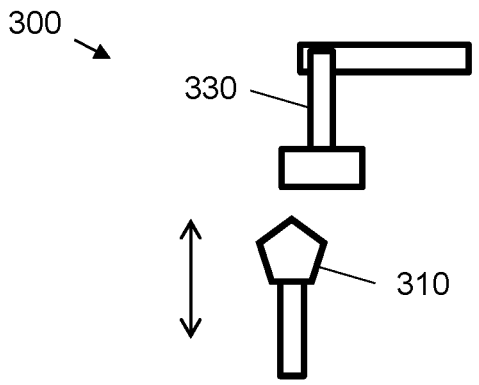
FIGS. 3A, 3B and 3C are schematic illustrations showing stages of an example method of calibrating a cleaning element.
Figure 3B:
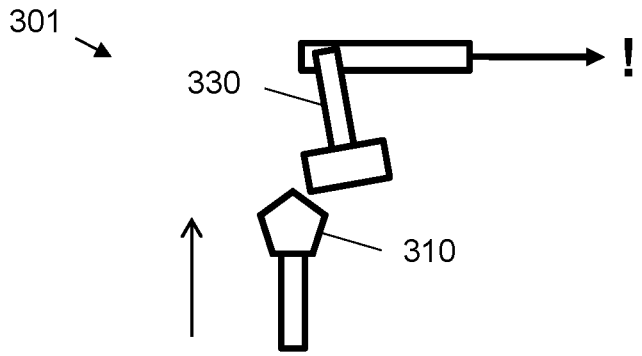
Figure 3C:
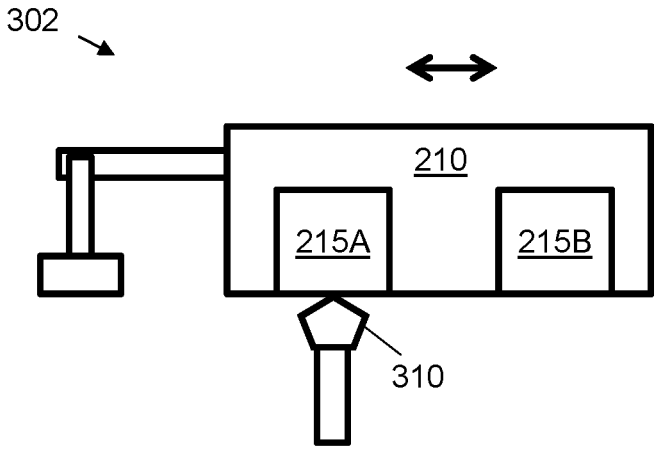

FIGS. 3A, 3B and 3C show examples 300, 301, 302 of how a cleaning element 310 may be calibrated using a print medium sensor 330. In these example, the print medium sensor 330 comprises a rotatable collision sensor as shown in FIGS. 2A and 2B; other forms of print medium sensor may be used in other examples. In FIG. 3A, the print medium sensor 330 is aligned with respect to the cleaning element 310. This may comprise moving moveable carriage 210 of FIG. 2A such that the print medium sensor 330 is located near or over the cleaning element 310. The cleaning element 310 may start in an "at rest" position. This may comprise a lowest possible vertical displacement or other known position. During the calibration routine, the cleaning element 310 is moved in relation to the print medium sensor 330. This movement is perpendicular to the nozzle plane of the printhead to be cleaned by the cleaning element 310. In FIG. 3A, the cleaning element 310 is moved vertically, whereas the nozzle plane is aligned horizontally with a base of the print medium sensor 310. The cleaning element 310 may be moved in known increments up and down.

In FIG. 3B, the cleaning element 310 is moved to a position where it displaces the print medium sensor 330. This leads to a detectable change in the state of the print medium sensor 330, which is referred to herein as "activation" of the print medium sensor 330. In the specific example of FIG. 3B, upward movement of the cleaning element 310 causes lateral displacement of the base of the print medium sensor 310 leading to rotation of the print medium sensor 330 about a pivot axis, such as axis 260 in FIG. 2B. In certain cases, the print medium sensor 330 may be moved laterally over the cleaning element 310 for each change in position of the cleaning element 310. For example, a moveable carriage such as 210 may be moved along an axis parallel to the nozzle plane to move the print medium sensor 330 back and forth over the cleaning element 310. In this case, when the cleaning element 310 projects into the nozzle plane, the print medium sensor 330 is activated.

When the print medium sensor 330 is activated, e.g. as shown in FIG. 3B, a displacement of the cleaning element 310 during the calibration routine may be recorded. This may be used to compute a reference position for the cleaning element 310, e.g. based on a distance between the nozzle plane as currently configured in the printing system and a resting position of the cleaning element 310.

FIG. 3C shows how a calibrated cleaning element 310 may be used to clean a printhead 215. In this case, the cleaning element 310 may be moved from a resting position to a position where the cleaning element 310 contacts the nozzles of the printhead 215. A total force to be applied by the cleaning element 310 may be proportional to a computed interference between the cleaning element 310 and the nozzle plane, e.g. the more the cleaning element 310 is displaced into the nozzle plane, the greater the applied force to the nozzles. In this case, the printhead may be moved laterally over the cleaning element 310 to wipe the nozzles. In certain cases, a force for a cleaning routine is set by setting an offset on top of the stored reference position from the calibration. This offset may set an amount of interference between the cleaning element and the nozzle plane.

In certain cases, the cleaning element described above may comprise a wiper. The wiper may be compressible, e.g. be made of rubber or the like. In certain cases, the wiper may have a polygonal cross-section, such that compression of the wiper against a set of nozzles deforms this polygonal cross-section in a controllable manner. For example, the wiper may have a pentagram cross-section. The wiper may extend across a width of a printhead, e.g. comprise an elongate prism that extends into the plane of FIGS. 3A, 3B and 3C. In certain cases, the printing system comprises a wiper support member that is translatable relative to a housing for the cleaning element. The wiper support member may be translatable to adjust a height of the wiper. A wiper may be mounted upon one or more wiper support members. In one case, a wiper support member may be provided at each end of an elongate wiper, e.g. such that the wiper bridges a width of a printhead. The cleaning element may comprise a cleaning cloth that is mounted, e.g. wound, over the wiper. In other cases, the cleaning element may comprise a wiper without a cleaning cloth. In certain cases, multiple cleaning elements may be used wherein some comprise a cleaning cloth and others comprise the wiper without a cleaning cloth. The cleaning element may be coupled to a motor or solenoid to provide linear translation. A cleaning unit containing the cleaning element may apply a cleaning fluid to the cleaning element during a cleaning routine.

Figure 4A:
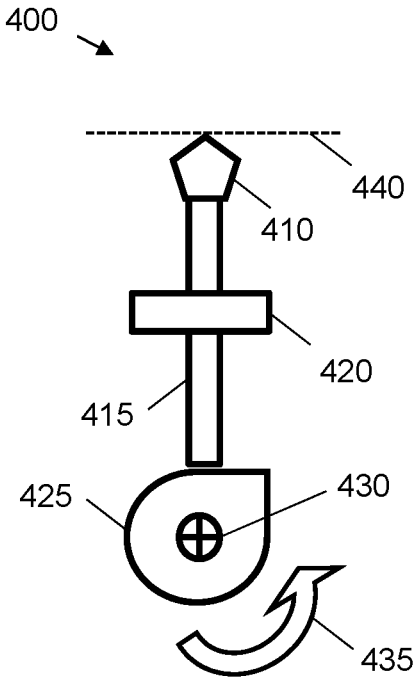
FIGS. 4A and 4B are schematic illustrations showing an example configuration for a cleaning element.
Figure 4B:
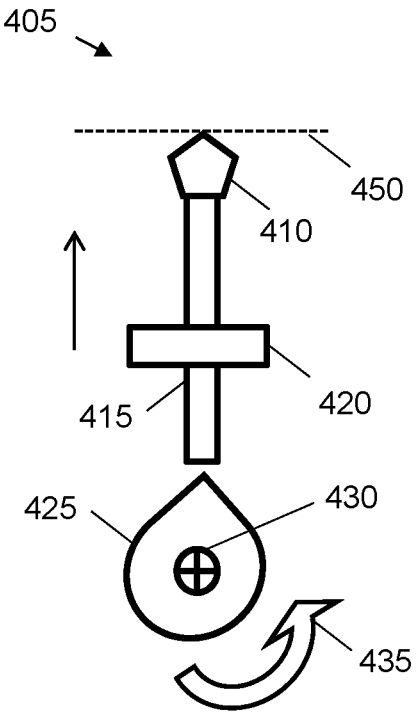

FIGS. 4A and 4B show an example of a sub-system to provide linear motion for the cleaning element. This example may be used to implement linear motion in any of the previous examples. In other examples, linear motion may be produced in other ways, e.g. using magnetic forces and/or rack and pinion systems.

FIG. 4A shows a first configuration 400. FIG. 4A shows a cleaning element 410 mechanically coupled to a support member 415. For example, the cleaning element 410 may be fastened to a top of the support member 415. The support member 415 is constrained laterally by a bracket 420 that forms part of a cleaning unit, i.e. a housing for the cleaning member 410. The bracket 420 may form an aperture within which movement of the support member 415 is constrained. For example, in FIG. 4A, the support member 415 may move vertically within the bracket 420. This arrangement may be replicated at another side of the cleaning unit, such that the cleaning element 410 extends into the Figures.

The support member 415 in FIGS. 4A and 4B rests upon a cam 425. The actual shape of the cam may vary from that shown schematically in the Figures. The cam 425 is rotatable about an axis 430 by a motor (not shown). In FIGS. 4A and 4B the cam is rotatable in the direction 435. As the cam 425 is rotated, the support member 415 is displaced upwards and the height of the cleaning element 410 is controlled. By using a cam 425 having a predefined shape and a stepper motor, a height of the cleaning element 410 is controlled by configuring an angle of rotation of the cam 425. For example, in FIG. 4A the cleaning element 410 has a first height 440 and in FIG. 4B the cleaning element 410 has a second height 450, which is greater than the first height 440. FIGS. 4A and 4B are presented as possible implementations but it would be understood that actual implementation may vary from that shown in the Figures while still providing linear motion of the cleaning element.

FIGS. 3A and 3B, and 4A and 4B, show schematic examples of cleaning element configurations. Other configurations are possible. For example, in one case, the cleaning element comprises a primary wiper coupled to a first wiper support member and a secondary wiper coupled to a second wiper support member. In this case, a motor may be used to control a height of the first and second wiper support members, e.g. through a common cam. The primary wiper may be mounted next to the secondary wiper, e.g. such that they are parallel along the width of the printhead. The two wipers may be configured to be alternately translatable, e.g. wherein the primary wiper projects into the nozzle plane first, then moves down, then the secondary wiper projects into the nozzle plane.

Although the previous examples show a printhead that is moveable in relation to a cleaning element, in other examples, a cleaning element may be moved in relation to the printhead. For example, a printhead may form part of a page wide array printer and the cleaning element may form part of a moveable carriage that may be moved underneath the printhead.

Figure 5:
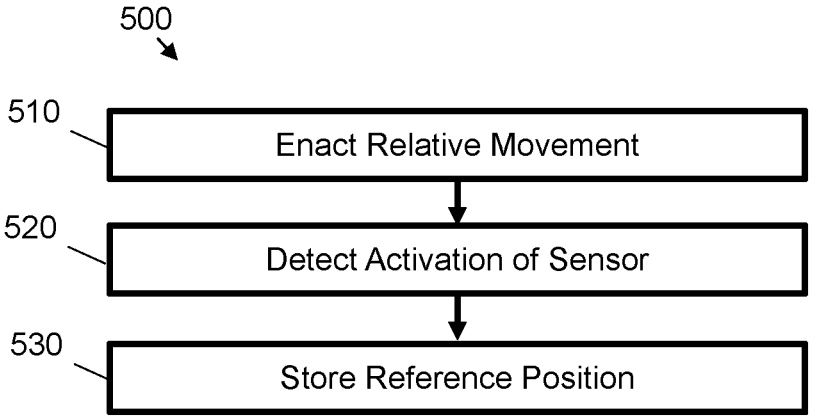
FIG. 5 is a flow diagram showing a method of calibrating a cleaning element for a printhead according to an example.

FIG. 5 shows an example method 500 of calibrating a cleaning element. This method may be implemented using the aforementioned examples, or on a differing system. The method begins at block 510, where relative movement between a printhead and the cleaning element is enacted. This may comprise moving a cleaning element towards or away from a nozzle plane of the printhead, e.g. moving the cleaning element up or down. This may comprise one or more incremental movements of a predefined displacement.

At block 520, during the relative movement, activation of a print medium sensor is detected. This may comprise print medium sensor 120 or 330. The print medium sensor is aligned with the nozzle plane of the printhead, e.g. a base of the sensor may be aligned with a base of the printhead. The print medium sensor is arranged to detect displacement, during a print job, of a print medium out of the nozzle plane. This displacement may be a bend, fold, wrinkle or crease in the print medium.

At block 530, a reference position for the cleaning element is stored based on the detected activation. For example, the reference position may be stored in a non-volatile memory of control circuitry such as 130. The reference position may be determined based on a measured number of displacements performed at block 510 before activation is detected at block 520. The reference position represents a measured gap or distance between the printhead and a top of the cleaning element. As such, during a cleaning routine, the cleaning element may be moved this distance plus an offset to apply a force to clean the nozzles of the printhead, e.g. by wiping the printhead. During the cleaning routine, relative movement may be enacted within the nozzle plane to wipe the nozzles.

Figure 6:
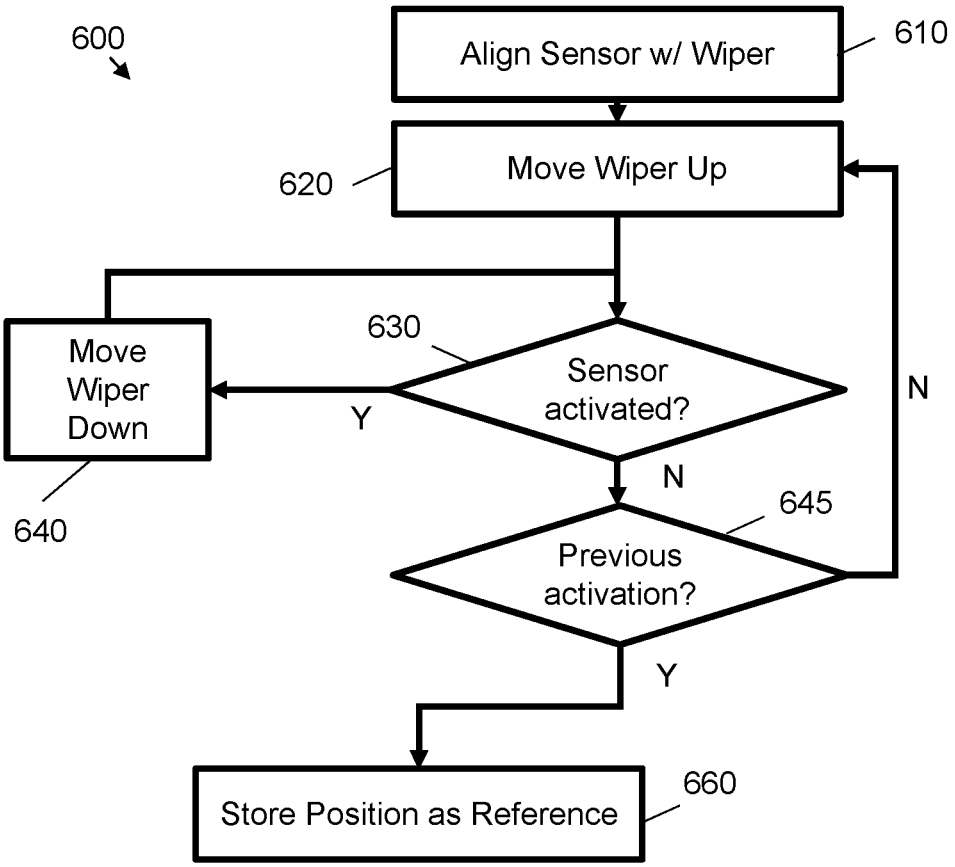
FIG. 6 is a flow diagram showing a method of calibrating a cleaning element for a printhead according to an example.

FIG. 6 shows a method 600 of calibrating a cleaning element according to another example. This may be seen as an extended version of the method 500 shown in FIG. 5. In this example, the cleaning element comprises a wiper that may be moved up and down with reference to a lower surface of a printhead mounting. However, blocks of this method may also be used with different cleaning element configurations.

At block 610, a position of the print medium sensor is aligned with a position of the wiper. This may comprise moving a moveable carriage to which the print medium sensor is attached such that the print medium sensor is above, or within a predefined range of, the top of the wiper within the nozzle plane. Block 610 may also comprise setting the wiper to a resting position. The exact position of the resting position with respect to the print medium sensor may not be known, however, the wiper may have a default position that is controllable using a linear actuator. For example, a motor may be set to a predefined angle (e.g. representing a lowest cam displacement) or a solenoid may be set to a particular state.

At block 620, the wiper is moved up. This may be seen as enacting relative movement between the printhead and the wiper. At block 630, a check is made to determine whether the print medium sensor has been activated. Block 630 may comprise enacting relative movement between the print medium sensor and the wiper parallel to the nozzle plane. For example, if the print medium sensor is set to be at a position to a side of the cleaning element at block 610, at block 630 it may be moved within the nozzle plane, e.g. transverse to the upwards movement at block 620. It may be determined whether activation occurs during this transverse movement.

If the print medium sensor is activated at block 630, the wiper is moved down at block 640. This may be seen as increasing a relative spacing between the printhead and the wiper. The check at block 630 is then applied again, e.g. including any transverse relative movement between the print medium sensor and the wiper.

If the print medium sensor is not activated at block 630, a check is made at block 645 to see whether the print medium sensor has been previously activated, e.g. whether a positive determination has been noted in the past at block 630. If there has been no previous activation, the method returns to block 620 and the wiper is moved up again. As such, responsive to an absence of a detected activation of the print medium sensor, a relative spacing between the printhead and the wiper is decreased.

If a previous activation has been noted at block 645, then the method proceeds to block 660, wherein the reference position of the wiper is set based on the current position of the wiper. For example, the method 600 ends with the wiper at a position that is just below the nozzle plane, e.g. a further movement upwards would trigger the print medium sensor.

In the method of FIG. 6, each movement at block 620 and 640 is based on a known increment. For example, in the examples of FIGS. 4A and 4B, the movements may be controlled by a rotation of a predefined number of degrees of a motor, wherein this can be mapped to a predefined vertical displacement based on a predefined cam design. Similarly, in a rack and pinion system this may be driven by a predefined rotation of the pinion. By summing the predefined displacements of the recorded upwards and downwards movements, a distance of the wiper at block 610 with reference to a nozzle plane of the printhead may be computed and used as a reference position for a cleaning routine.

Figure 7:
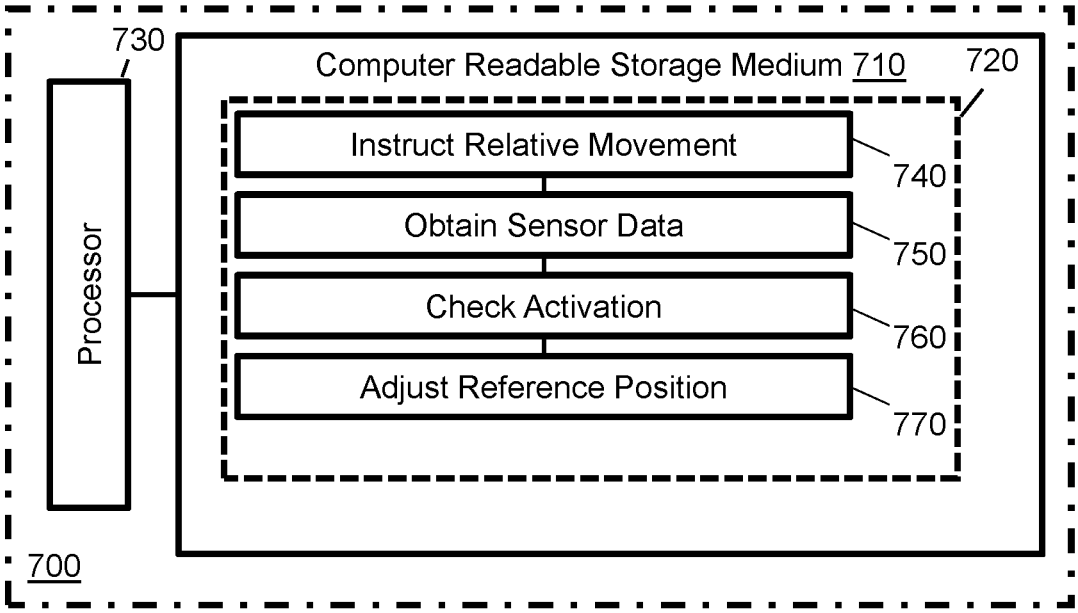
FIG. 7 is a schematic illustration showing a non-transitory computer-readable storage medium according to an example.

FIG. 7 shows an example 700 of a non-transitory computer-readable storage medium 710 comprising a set of computer-readable instructions 720. The instructions 720 are executable by a processor 730 of a printing system. The computer readable storage medium 710 may be a memory of a processor such as an embedded processor or microprocessor that forms part of a printing system, e.g. forms part of a printer. The memory may comprise a non-volatile memory where instructions are stored when no power is supplied and a volatile memory where instructions are loaded during use for execution by the processor. The instructions may comprise part of firmware of a print device.

Instruction 740 causes the processor to instruct, during a calibration routine, relative movement between a printhead of the printing system and a cleaning element for the printhead. The printhead and cleaning element may comprise components as discussed with reference to other examples herein. Instruction 750 causes the processor to obtain sensor data from a print medium sensor of the printing system during the calibration routine. The print medium sensor is arranged to detect displacement, during a print job, of a print medium relative to a plane of the printhead. The print medium sensor may comprise a print medium sensor as discussed with reference to other examples herein. Instruction 760 causes the processor to determine whether the sensor data indicates activation of the print medium sensor during the calibration routine. Lastly, instruction 770 causes the processor to conditionally adjust a reference position of the cleaning element relative to the printhead response to the determination.

The instructions 720 may enable a processor of the control circuitry 130 to perform the calibration routines as described in examples herein. In certain cases, the instruction 770 to adjust a reference position of the cleaning element comprise instructions to cause the processor to, responsive to a determined activation of the print medium sensor, increase a height of the cleaning element and, responsive to an absence of a determined activation of the print medium sensor, decrease a height of the cleaning element. Hence, instruction 770 may instruct blocks similar to 620 and 640 in FIG. 6. In this case, instruction 770 may also store the reference position as a height of the cleaning element responsive to an absence of a determined activation of the print medium sensor following a previous determined activation of the print medium sensor, e.g. as described with reference to block 660 of FIG. 6.

In certain cases, the instructions 720 may include instructions to disable a print interrupt during the calibration routine, such that activation of the print medium sensor does not interrupt the calibration routine. For example, during a print job, activation of the print medium sensor may stop a moveable carriage comprising the printhead, e.g. via an interrupt signal that is processed by printing control circuitry. A print job may also be stopped or paused to allow clearance of a print media jam. During the calibration routine, the activation of the print medium sensor may not stop or interrupt movement of the moveable carriage and/or the flow of the instructions 720. For example, the interrupt signal may be disabled by modifying the control processing of the printer, e.g. to allow reporting and/or recording of the data received from the print medium sensor.

The preceding description has been presented to illustrate examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method of calibrating a cleaning element for a printhead, comprising:

enacting relative movement between the printhead and the cleaning element;

during the relative movement, detecting activation of a print medium sensor to detect displacement during a print job of a print medium out of the nozzle plane, the print medium sensor being aligned with a nozzle plane of the printhead; and storing a reference position for the cleaning element based on the detected activation.

2. The method of claim 1, comprising, prior to enacting relative movement:

aligning a position of the print medium sensor with a position of the cleaning element.

3. The method of claim 1, wherein enacting relative movement comprises:

enacting relative movement between the print medium sensor and the cleaning element parallel to the nozzle plane.

4. The method of claim 1, comprising:

responsive to a detected activation of the print medium sensor, increasing a relative spacing between the printhead and the cleaning element; and responsive to an absence of a detected activation of the print medium sensor, decreasing a relative spacing between the printhead and the cleaning element.

5. The method of claim 4, comprising:

setting the reference position as a position of the cleaning element responsive to an absence of a detected activation of the print medium sensor following a previous detected activation of the print medium sensor.

6. A printing system comprising:

a printhead mounting to mount a printhead;

a print medium sensor coupled to the printhead mounting, the print medium sensor to detect, during a print job, displacement of a print medium out of a nozzle plane of the printhead;

at least one cleaning element to clean the printhead; and control circuitry to move the cleaning element relative to the printhead mounting and to detect an activation of the print medium sensor, the control circuitry being configured to calibrate a reference position for the cleaning element based on the activation.

7. The printing system of claim 6, wherein the printhead mounting forms part of a moveable carriage and the print medium sensor is mechanically coupled to the moveable carriage.

8. The printing system of claim 6, wherein the print medium sensor comprises a collision sensor pivotably-mounted to the moveable carriage, wherein activation of the print medium sensor is detected via a rotation of the collision sensor.

9. The printing system of claim 6, wherein the cleaning element comprises a wiper and the printing system further comprises:

a wiper support member that is translatable relative to a housing to adjust a height of the wiper.

10. The printing system of claim 9, wherein the wiper support member is laterally constrained within the housing and supported upon a cam, wherein rotation of the cam moves the wiper support member within the housing to adjust the height of the wiper.

11. The printing system of claim 9, wherein the cleaning element comprises:

a cleaning cloth mounted over the wiper.

12. The printing system of claim 6, where the cleaning element comprises:

a primary wiper coupled to a first wiper support member;

a secondary wiper coupled to a second wiper support member; and a motor to control a height of the first and second wiper support members.

13. A non-transitory computer-readable storage medium comprising a set of computer-readable instructions stored thereon, which, when executed by a processor of a printing system, cause the processor to:

instruct, during a calibration routine, relative movement between a printhead of the printing system and a cleaning element for the printhead;

obtain sensor data from a print medium sensor of the printing system during the calibration routine, the print medium sensor to detect displacement, during a print job, of a print medium relative to a plane of the printhead;

determine whether the sensor data indicates activation of the print medium sensor during the calibration routine; and responsive to the determination, adjust a reference position of the cleaning element relative to the printhead.

14. The medium of claim 13, wherein the instructions to adjust a reference position of the cleaning element comprise instructions to cause the processor to:

responsive to a determined activation of the print medium sensor, increase a height of the cleaning element;

responsive to an absence of a determined activation of the print medium sensor, decrease a height of the cleaning element; and store the reference position as a height of the cleaning element responsive to an absence of a determined activation of the print medium sensor following a previous determined activation of the print medium sensor.

15. The medium of claim 13, wherein the instructions cause the processor to:

disable a print interrupt during the calibration routine, such that activation of the print medium sensor does not interrupt the calibration routine.

* * * * *